US011958575B2

(12) United States Patent
Hellesmark et al.

(10) Patent No.: US 11,958,575 B2
(45) Date of Patent: Apr. 16, 2024

(54) SYSTEM FOR OFFSHORE PRODUCTION OF FUEL

(71) Applicant: Stena Power & LNG Solutions AS, Grimstead (NO)

(72) Inventors: Svein Borge Hellesmark, Fevik (NO); Göran Hermansson, Gothenburg (NO)

(73) Assignee: Stena Power & LNG Solutions AS, Grimstad (NO)

( * ) Notice: Subject to any disclaimer, the term of this patent is extended or adjusted under 35 U.S.C. 154(b) by 0 days.

(21) Appl. No.: 18/334,964

(22) Filed: Jun. 14, 2023

(65) Prior Publication Data

US 2023/0406458 A1 Dec. 21, 2023

Related U.S. Application Data

(60) Provisional application No. 63/366,410, filed on Jun. 15, 2022.

(51) Int. Cl.
*B63B 35/44* (2006.01)
*E02B 17/00* (2006.01)

(52) U.S. Cl.
CPC ..... *B63B 35/44* (2013.01); *E02B 17/00* (2013.01); *B63B 2035/4486* (2013.01); *E02B 2017/0091* (2013.01)

(58) Field of Classification Search
CPC . B63B 35/44; B63B 2035/4486; E02B 17/00; E02B 2017/0091
See application file for complete search history.

(56) References Cited

U.S. PATENT DOCUMENTS 2,391,926 A * 1/1946 Edmiston ..... B63B 35/285 114/244
3,643,447 A * 2/1972 Pogonowski ..... B65D 88/78 166/351

(Continued)

FOREIGN PATENT DOCUMENTS

KR 20220053060 A 4/2022
KR 20220053062 A 4/2022

OTHER PUBLICATIONS

Partial Search Report issued for International Patent Application No. PCT/NO2023/050141, dated Oct. 9, 2023, 10 pages, ISR/EP.

*Primary Examiner* — Stephen P Avila
(74) *Attorney, Agent, or Firm* — Haynes and Boone, LLP

(57) ABSTRACT

A method and system for the offshore production of fuel includes an offshore marine platform on which is mounted a hydrogen production unit. The hydrogen production unit may produce hydrogen utilizing raw materials sourced adjacent the marine platform, including seawater and electricity from offshore wind turbines. The produced hydrogen may then be blended onboard the marine platform with liquefied natural gas delivered to the marine platform in order to produce a blended fuel comprised of the delivered natural gas and a portion of the produced hydrogen. The blended fuel may be subsequently liquified and transported away from the marine platform, or conveyed to a remote location via a seabed pipeline, or combusted by onboard combustion turbines that can in turn drive electric generators onboard the marine platform to produce electricity.

29 Claims, 6 Drawing Sheets

(56) References Cited

U.S. PATENT DOCUMENTS

| | | | | |
|---|---|---|---|---|
| 4,648,751 | A * | 3/1987 | Coleman | E02B 17/02<br>405/209 |
| 2003/0168864 | A1 * | 9/2003 | Heronemus | F03D 9/255<br>290/55 |
| 2007/0033945 | A1 * | 2/2007 | Goldmeer | F02C 3/20<br>60/774 |
| 2019/0161146 | A1 | 5/2019 | Hellesmark et al. | |

* cited by examiner

SYSTEM FOR OFFSHORE PRODUCTION OF FUEL

PRIORITY CLAIM

This application claims the benefit of priority to U.S. Provisional Application No. 63/366,410, filed Jun. 15, 2022 the benefit of which is claimed and the disclosure of which is incorporated by reference in its entirety.

FIELD OF THE INVENTION

The present disclosure generally relates to production of fuel for power generation, and more particularly to the production of hydrogen utilizing offshore fuel production facilities.

BACKGROUND OF THE INVENTION

It is known to use natural gas, which is predominantly made up of methane ($CH_4$), for heating and generating electricity. In particular, natural gas may be burned as fuel in the combustion turbines to produce mechanical power that is converted to electric power by electric generators. However, upon combustion of the natural gas, carbon dioxide ($CO_2$) is produced as a byproduct. The environmental impacts of greenhouse gases such as carbon dioxide are known, and therefore, there is a desire to reduce carbon dioxide emissions in the production of electricity by identifying other fuels for combustion turbines. In this regard, the use of hydrogen as an alternative fuel to natural gas in the production of electricity has been gaining traction.

As hydrogen grows in prominence as a fuel, there is a greater need to make it more accessible. However, the primary form of hydrogen production, namely steam methane reforming, in fact results in the production greenhouse gases along with the produced hydrogen. Thus, in addition to accessibility, there is a need to minimize production of greenhouse gases in the production of hydrogen fuel.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Disclosed herein is a method and system for production of hydrogen fuel at an offshore marine platform. Gaseous hydrogen produced by an in situ hydrogen production system on the platform may be piped to an onshore location, or alternatively, may be liquified for transport by a liquefied hydrogen transport vessel. The offshore marine platform includes a water purification unit for purifying seawater collected from adjacent the marine platform. The purified water is used in an onboard hydrogen production system to produce gaseous hydrogen. A liquified hydrogen storage unit may be positioned adjacent the marine platform to collect in bulk liquified hydrogen produced on the platform until the liquefied hydrogen can be loaded on a transport vessel. In one or more embodiments, in addition to the floating liquified hydrogen storage unit, a floating liquified natural gas storage unit is positioned adjacent the marine platform to allow blending of produced hydrogen with natural gas prior to pipeline transfer. In other embodiments, the offshore marine platform is disposed to blend electricity produced by adjacent offshore wind turbines with electricity produced onboard the marine platform utilizing liquified natural gas stored on a liquified natural gas floating storage unit moored adjacent the marine platform. In one or more embodiments, in addition to the floating liquified natural gas storage unit moored adjacent the marine platform, a floating liquified hydrogen storage unit is positioned adjacent the marine platform so that gaseous hydrogen can be blended with natural gas prior to producing onboard electricity to be blended with electricity from the adjacent wind turbines.

Figure 1:
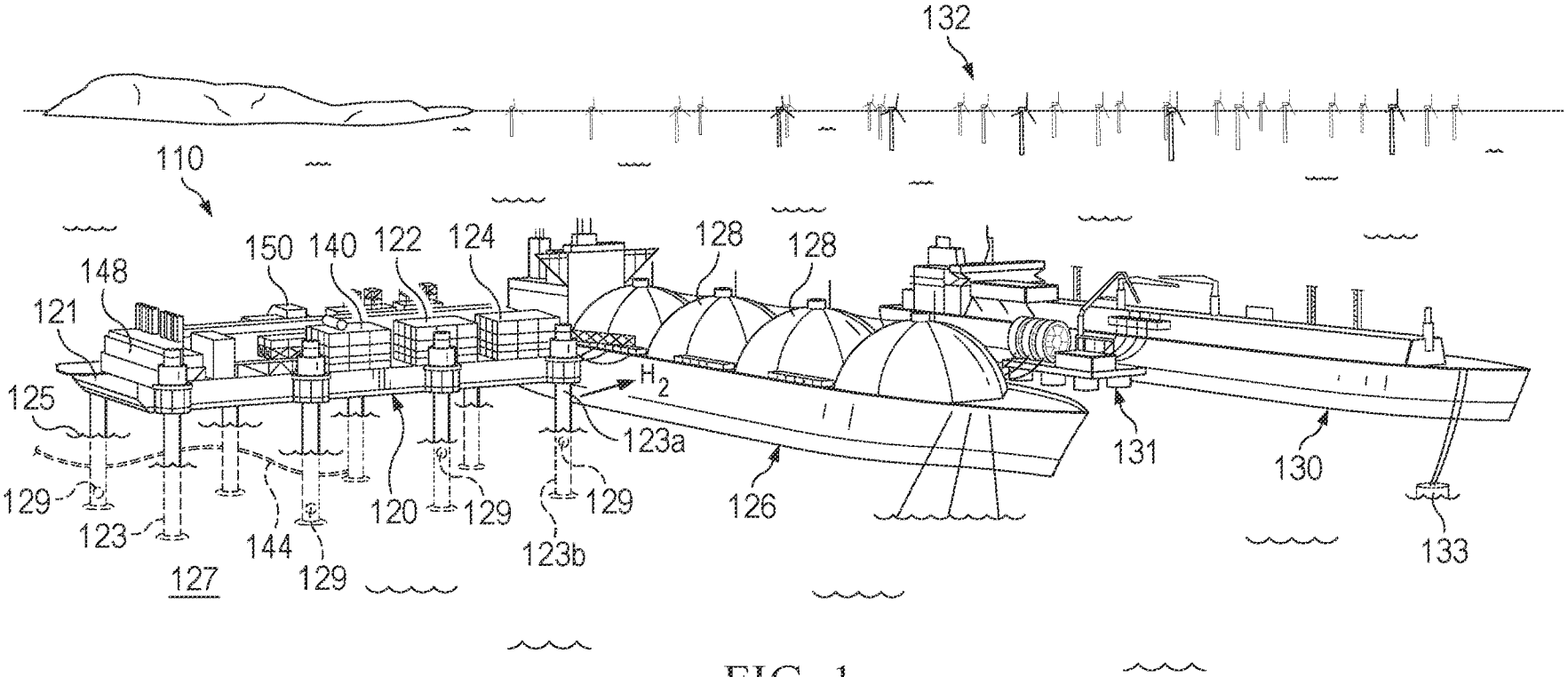
FIG. 1 is an offshore marine system for hydrogen-based fuel production.

With reference to FIG. 1, a hydrogen fuel production system 110 includes an offshore marine platform 120 having a hydrogen production unit 122 and a gaseous hydrogen liquefaction unit 124 for the production of liquified hydrogen, which liquified hydrogen can then be bulk stored on a liquified hydrogen storage unit 126 on marine platform 120 or adjacent marine platform 120. In one or more embodiments, liquefied hydrogen storage unit 126 is a liquified hydrogen floating storage unit 126 and may include a plurality of bulk storage tanks 128 for receipt of liquified hydrogen produced onboard marine platform 120. In the illustrated embodiment, liquified hydrogen produced at marine platform 120 and stored in bulk by liquified hydrogen floating storage unit 126 can be transferred to a liquefied hydrogen transport vessel 130 for transport to other locations. While they may be spaced apart from one another, in one or more embodiments, liquefied hydrogen floating storage unit 126 is moored in close proximity to the marine platform 120 so that a continuous flow of liquified hydrogen can be maintained therebetween as the liquified hydrogen is produced without the need for an intermediate storage, it being understood that in instances where hydrogen production unit 122 has a low output volume, the low volume may not allow the liquid to be readily pumped to a storage unit that is a distance removed from the marine platform 120 or directly to a liquefied hydrogen transport vessel 130. In this regard, liquefied hydrogen floating storage unit 126 is desirable because it can be utilized as a collection reservoir for liquified hydrogen produced onboard marine platform 120 until a sufficient quantity of liquefied hydrogen has been produced for transport to another location by liquefied hydrogen transport vessel 130. In this regard, liquified hydrogen floating storage unit 126 has a first total liquified hydrogen storage volume and liquefied hydrogen transport vessel 130 has a second total liquified hydrogen storage volume that is less than the first total liquified hydrogen storage volume In one or more embodiments, liquefied hydrogen transport vessel 130 may be moored at moorings 133 that are spaced apart from liquefied hydrogen floating storage unit 126 and marine platform 120. In such case, a floating transfer terminal 131 may be utilized to transfer liquified hydrogen from the liquefied hydrogen floating storage unit 126 to the liquefied hydrogen transport vessel 130.

In one or more embodiments, marine platform 120 may be a jack-up platform, a semi-submersible platform, a barge, a buoyant vessel, a fixed platform, a spar platform, or a tension-leg platform which is fixed to the ocean floor or otherwise moored for long periods of deployment in a single location. In other embodiments, marine platform 120 may be a floating vessel such as a barge or ship that can be moored in place for long term deployment. In other embodiments, marine platform 120 may be a floating vessel such as a barge or ship. Moreover, while marine platform 120 and liquified hydrogen floating storage unit 126 are shown separately, they can be integrally formed either on the marine platform 120 or the liquified hydrogen floating storage unit 126.

In one or more embodiments, marine platform 120 includes at least one platform deck 121 and three or more platform legs 123, where each platform leg 123 has a first end 123*a* and a second end 123*b*. Platform deck 121 is disposed adjacent the first end 123*a* of each platform leg 123 and supported above the ocean surface 125. The second end 123*b* of each platform leg 123 may engage the seabed 127.

Hydrogen fuel production system 110 may include one or more seawater intakes 129 to draw in seawater for use in the hydrogen production process. While seawater intakes 129 are not limited to a particular system for drawing in seawater, in one or more embodiments, one or more seawater intake(s) 129 may be disposed adjacent the second end 123*b* of a platform leg 123 of marine platform 120 to draw in cooler water from the adjacent body of seawater, while in other embodiments, seawater intake 129 is disposed between the first and second leg ends 123*a*, 123*b*, respectively, of a platform leg 123, adjacent the ocean surface 125, to draw in warmer water from the adjacent body of seawater. The vertical height of seawater intake 129 may be adjusted based on the season to ensure the seawater used in the process is at an optimum temperature for purification and use in the hydrogen production process. In yet other embodiments, a first plurality of seawater intakes 129 may be disposed adjacent the second end 123*b* of one or more platform legs 123 and a second plurality of seawater intakes 129 may be spaced apart from the second end 123*b* of one or more platform legs 123. In other words, the first plurality of seawater intakes 129 may be a first distance from the second end 123*b* of one or more legs 123 and the second plurality of seawater intakes 129 may be a second distance from the second end 123*b* of one or more legs 123, where the second distance is greater than the first distance. In some embodiments, the second distance may be at least twice the first distance so that seawater in different thermoclines may be used in the processes onboard marine platform 120, taking advantage of warmer mixed water at the surface and the cooler deep water below. For example, the liquefaction units or regasification systems described herein may utilize seawater at a first temperature for heat transfer, while the hydrogen production unit may utilize purified seawater at a second temperature for hydrogen production.

In any event, hydrogen production unit 122 utilizes hydrogen (H 2) from raw materials sourced onboard marine platform 120, i.e., purified water, to produce the liquified hydrogen. Moreover, electricity for hydrogen production unit 122 is provided to marine platform 120 for the production of hydrogen by offshore wind turbines 132 disposed in the vicinity of marine platform 120.

Marine platform 120 also includes a water purification unit 140 to purify seawater where the hydrogen production unit 122 utilizes purified water from the water purification unit 140 to produce hydrogen for use in the hydrogen production unit 122.

In one or more embodiments, prior to liquefaction, a portion of the produced hydrogen may be transmitted to an onshore or near shore location or terminal via a seabed conveyance system 144, such as the illustrated hydrogen gas pipeline conveyance system 144 shown extending away from the marine platform 120 along the seabed 127. Alternatively, or in addition thereto, a portion of the produced hydrogen may be utilized onboard marine platform 120 to generate electricity. In other words, a first portion of the produced hydrogen is liquified and stored on liquefied hydrogen floating storage unit 126, while a second portion of the produced hydrogen is utilized onboard marine platform 120 for power production. Thus, in one or more embodiments, marine platform 120 may include one or more combustion turbines 148 for combusting the second portion of the produced hydrogen to provide mechanical power that is converted to electric power by one or more electric generators 150. In this regard, the combustion turbines 148 are in fluid communication, either directly or indirectly, with the hydrogen production unit 122 in order to utilize at least a portion of the produced hydrogen for fuel in the combustion turbines 148. It will be appreciated that combustion turbines 148 may include other devices utilized to combust fuel to produce power, including, without limitation, internal combustion engines.

In yet other embodiments, conveyance system 144 may be an electrical cable in addition to or as an alternative to a hydrogen gas pipeline. Where conveyance system 144 is an electrical cable, excess power from offshore wind turbines 132 may be transmitted to shore from marine platform 120. In any event, conveyance system 144 is shown extending away from marine platform 120 along the seabed 127. In one or more embodiments, conveyance system 144 extends from adjacent the second end 123*b* of a leg 123.

Figure 2:
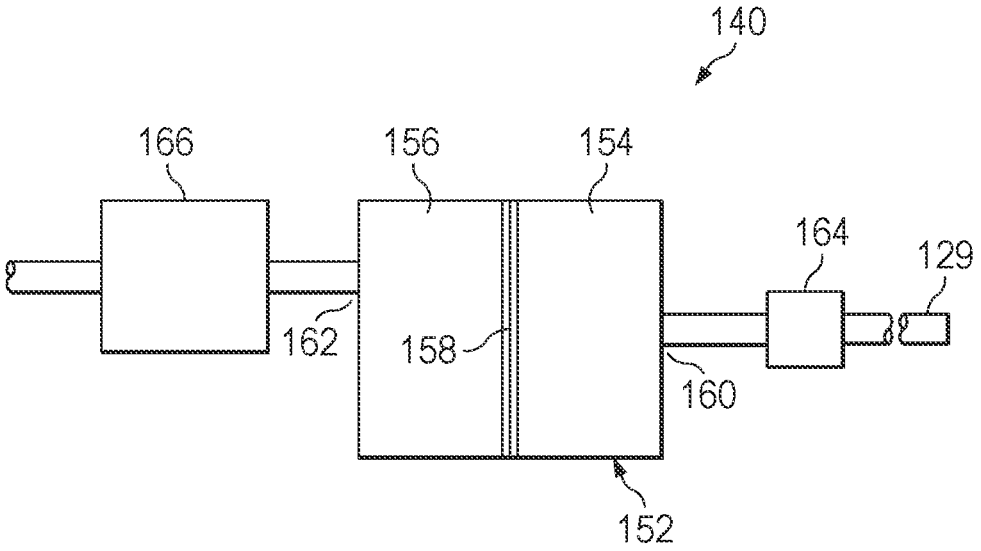
FIG. 2 is one embodiment of a water purification unit to be used in the offshore marine system of FIG. 1.

With reference to FIG. 2, while not limited to a particular water purification unit, in some embodiments, water purification unit 140 utilizes reverse osmosis and includes a water purification vessel 152 having a first chamber 154 and a second chamber 156 with a semi-permeable membrane 158 disposed between the first and second chambers 154, 156. A seawater inlet 160 is provided in the first chamber 154 and a purified water outlet 162 is provided in the second chamber 156. Water purification unit 140 also includes a pump 164 for pressurizing the seawater in the first chamber 154. Pump 164 is in fluid communication with seawater intake(s) 129 to draw in seawater for purification.

While semi-permeable membrane 158 may be any membrane known for use in reverse osmosis, in one or more embodiments, semi-permeable membrane 158 may be a thin polyamide layer (<200 nm) deposited on top of a polysulfone porous layer (about 50 microns) on top of a non-woven fabric support sheet and having a pore size of approximately 0.0001 micron. Seawater drawn in and pumped to the water purification unit 140 where the water purification unit 140 is utilized to at least partially purifying the pumped seawater to yield purified water, after which, the hydrogen production unit 122 is used to generate gaseous hydrogen from the purified water. In one or more embodiments, a purified water storage vessel 166 is fluidically disposed between the purified water outlet 162 of the water purification unit 140 and the hydrogen production unit 122.

Figure 3:
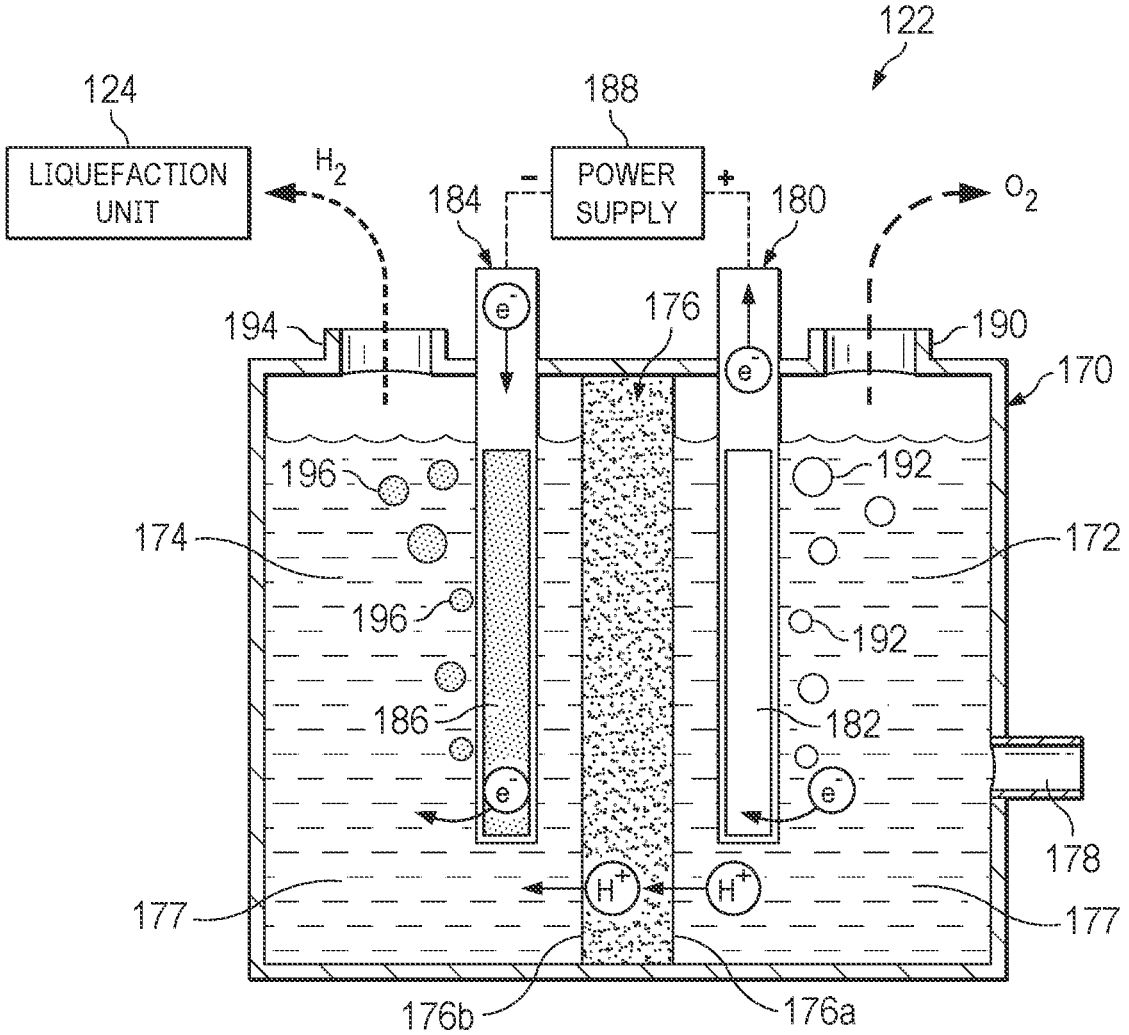
FIG. 3 is one embodiment of a hydrogen production unit to be used in the offshore marine system of FIG. 1.

Turning to FIG. 3, while not limited to a particular hydrogen production system, in some embodiments, hydrogen production unit 122 on board marine platform 120 utilizes electrolysis to produce hydrogen. Thus, in the illustrated hydrogen production unit 122, a hydrogen production vessel 170 is provided, having a first chamber 172 and a second chamber 174 with a membrane 176 disposed between the first and second chambers 172, 174. While not limited to a particular type of membrane, in one or more embodiments, membrane 176 is a proton exchange membrane (PEM) or alkaline membrane. However, other membranes may also be utilized. In any event, purified water 177 from water purification unit 140 is delivered to hydrogen production vessel 170 via a purified water inlet 178 provided in hydrogen production vessel 170. An anode assembly 180 having an anode 182 extending into first chamber 172 is provided on a first side 176*a* of the membrane 176, and a cathode assembly 184 having a cathode 186 extending into second chamber 174 is provided on a second side 176*b* of membrane 176. A power supply 188 electrically couples anode assembly 180 and cathode assembly 184. As will be appreciates, purified water 177 may be provided in either first chamber 172, second chamber 174 or both, depending on the hydrogen production unit 122. Relatedly, a purified water inlet 178 may likewise be provided in either first chamber 172, second chamber 174 or both. In any event, an oxygen outlet 190 is provided in first chamber 172 for allowing oxygen 192 to pass therethrough, and a hydrogen outlet 194 is provided in second chamber 174 for allowing hydrogen 196 to pass therethrough. In one or more embodiments, electricity is provided to power supply 188 from offshore wind turbines 132 (see FIG. 1), while in other embodiments, electricity may be provided to power supply 188 from another source, such as electric generators disposed onboard marine platform 120.

Figure 4:
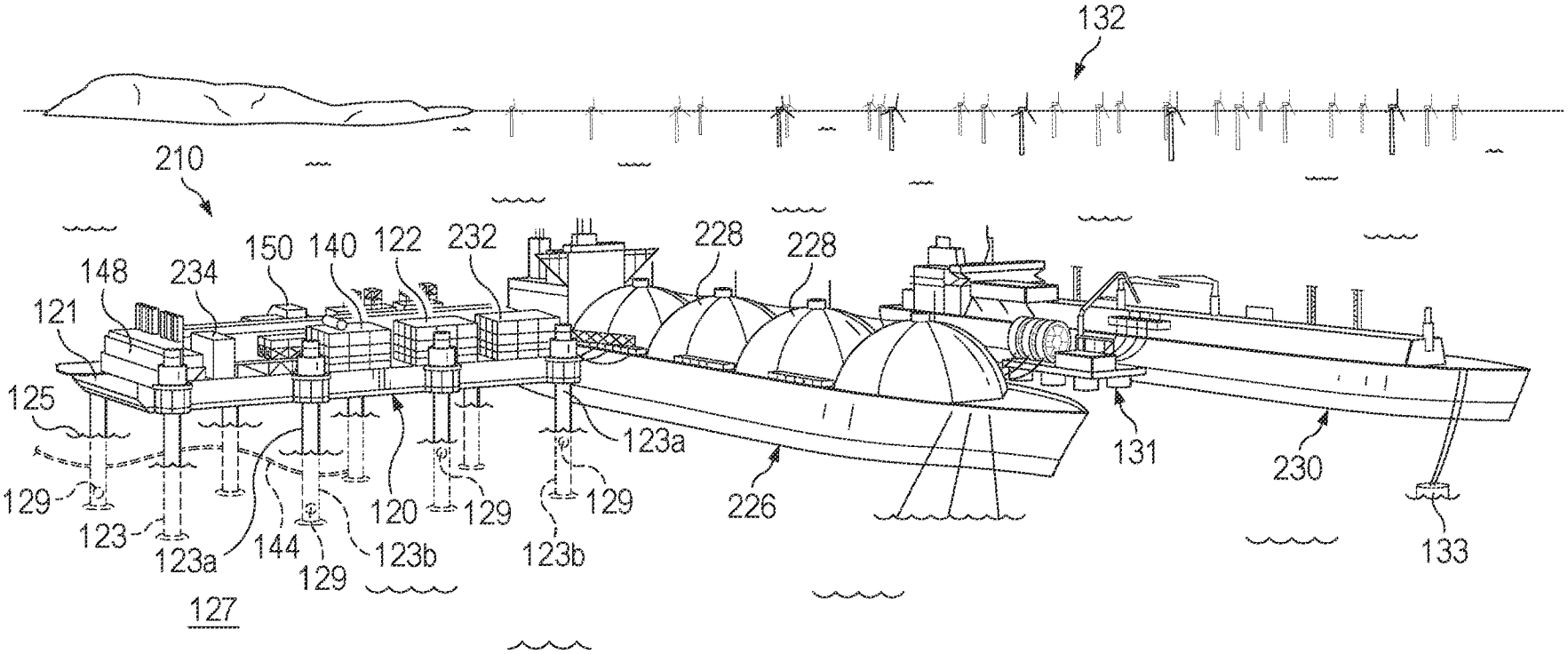
FIG. 4 is the offshore marine system of FIG. 1 with a liquified natural gas floating storage unit and blending unit for the production of blended fuel.

FIG. 4 illustrates an embodiment of a hydrogen fuel production system 210 disposed to provide blended fuel of natural gas and hydrogen in order to accommodate combustion systems that are not disposed for combustion of hydrogen gas alone. In this embodiment, natural gas is delivered to marine platform 120 and blended with hydrogen produced on marine platform 120 as described above with respect to FIGS. 1-3. Thus, in the embodiment shown in FIG. 4, in addition to a hydrogen production unit 122 and water purification unit 140 as described above with respect to FIG. 1, hydrogen fuel production system 210 also includes a regasification system 232 for regasification of the delivered liquefied natural gas and a blending unit 234 disposed to receive gaseous hydrogen and gaseous natural gas and produce a blended natural gas.

In the illustrated embodiment, a liquified natural gas floating storage unit 226 having storage tanks 228 is provided adjacent marine platform 120 and disposed to bulk store liquefied natural gas (LNG1) delivered by a liquified natural gas transport vessel 230. The percentage amount of hydrogen in the delivered natural gas may be minimal, such as less than 0.5% in some embodiments, or less than 1% in other embodiments or less than 3% in yet other embodiments. In still other embodiments, the percentage of hydrogen in the delivered natural gas is simply less than a desired percentage of hydrogen in a blended fuel. In any event, hydrogen fuel production system 210 therefore includes a first pump to transfer by pumping the delivered natural gas LNG1 from floating storage unit 226 to marine platform 120 for processing.

Hydrogen fuel production system 210 produces gaseous hydrogen as described above utilizing water purification unit 140 to deliver purified water to hydrogen production unit 122. In one or more embodiments, the electricity for hydrogen production unit 122 is provided to marine platform 120 for the production of hydrogen by offshore wind turbines 132 disposed in the vicinity of marine platform 120. In addition, liquefied natural gas delivered to floating storage unit 226 is regasified by regasification system 232 to produce natural gas for blending, after which the produced hydrogen and delivered natural gas are mixed together in desired proportions by blending unit 234 which includes a gaseous hydrogen input, a gaseous natural gas input and a blended fuel output, where the blended fuel is natural gas with an increased hydrogen content. Thus, each of regasification system 232 and hydrogen production unit 122 are in fluid communication with blending unit 234 which produces a blended fuel from the input gasses. Although the blending process and blended fuel as described herein are not limited to a particular blending ratio, in one or more embodiments, the blended fuel comprises no more than about 25% hydrogen. In other embodiments, the proportion of hydrogen to natural gas in the blended fuel may be higher. Moreover, as combustion turbines and other industrial equipment are specifically designed to accommodate higher percentages of hydrogen as a combustion fuel, the blended ration may correspondingly increase.

In one or more embodiments, a portion of the blended fuel may be transmitted to an onshore or near shore location or terminal via a conveyance system 144, such as the illustrated gas pipeline conveyance system 144. Alternatively, or in addition thereto, a portion of the blended fuel may be utilized onboard marine platform 120 to generate electricity. Thus, marine platform 120 may include one or more combustion turbines 148 for combusting the blended fuel to provide mechanical power that is converted to electric power by one or more electric generators 150. In this case, conveyance system 144 may be an electrical cable in addition to or as an alternative to a gas pipeline for the blended fuel. Where conveyance system 144 is an electrical cable, excess electricity from offshore wind turbines 132 may be transmitted to shore from marine platform 120 along with electricity produced from electric generators 150. In some embodiments, electricity from offshore wind turbines 132 may be utilized to produce hydrogen for mixing with natural gas, while electricity from electric generators 150 may be transmitted via conveyance system 144.

Figure 5:
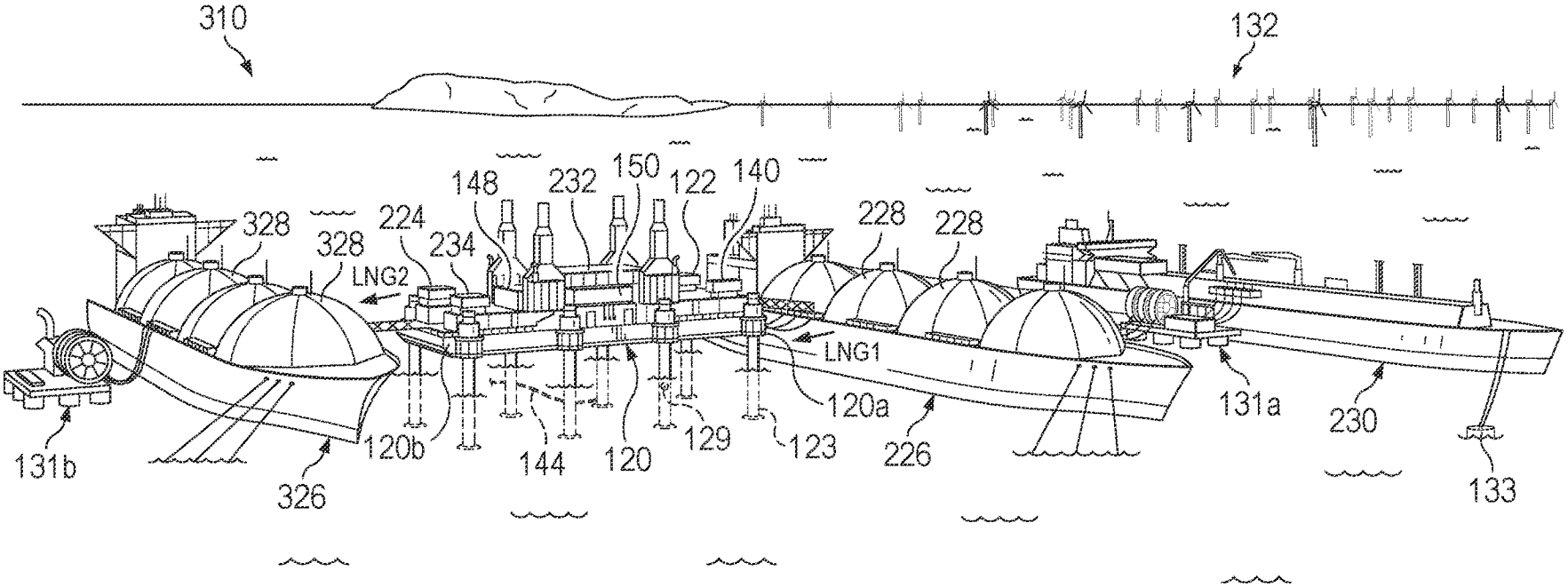
FIG. 5 is another embodiment of an offshore marine system for production of hydrogen-blended liquefied natural gas.

FIG. 5 illustrates another embodiment of a hydrogen fuel production system 310 disposed to provide blended natural gas in order to accommodate combustion systems that are not disposed for combustion of hydrogen gas alone. In this embodiment, natural gas having a first percentage of hydrogen is delivered to marine platform 120 and regassified. The first percentage of hydrogen in the delivered natural gas may be minimal, such as less than 0.5% in some embodiments, or less than 1% in other embodiments or less than 3% in yet other embodiments. In still other embodiments, the first percentage of hydrogen in the delivered natural gas is simply less than a desired second percentage of hydrogen in a blended fuel. This regassfied natural gas is then blended with gaseous hydrogen from a hydrogen source at marine platform 120, after which the blended fuel is liquified and stored for transport by a transport vessel. In some embodiments, the hydrogen source at marine platform 120 is hydrogen produced onboard marine platform 120 as described above with respect to FIGS. 1-3. Thus, in the embodiment shown in FIG. 5, in addition to a hydrogen production unit 122 and water purification unit 140 as described above with respect to FIG. 1, hydrogen fuel production system 310 also includes a regasification system 232, a blending unit 234 and a liquefaction unit 224.

In the illustrated embodiment, a first liquified natural gas floating storage unit 226 having storage tanks 228 is provided adjacent marine platform 120 and disposed to bulk store liquefied natural gas delivered by a liquified natural gas transport vessel 230. This delivered natural gas stored on floating storage unit 226 is characterized as storing liquefied natural gas having the first percentage of hydrogen (LNG1). Hydrogen fuel production system 310 therefore includes a first pump to transfer by pumping LNG1 from floating storage unit 226 to marine platform 120 for processing. In addition, a second liquified natural gas floating storage unit 326 having storage tanks 328 is provided adjacent marine platform 120 and disposed to bulk store liquefied natural gas having the second percentage of hydrogen (LNG2), namely liquified blended fuel for transport to other locations. This blended fuel is comprised of natural gas having a second percentage of hydrogen that is greater than the first percentage of hydrogen. Hydrogen fuel production system 310 therefore includes a second pump to transfer by pumping LNG2 from marine platform 120 to floating storage unit 326 for collection and storage prior to shipping.

A liquified natural gas transport vessel 230 may then be used to loaded with the liquified blended fuel from second liquified natural gas floating storage unit 326 for transport to other locations. In one or more embodiments, the same liquified natural gas transport vessel 230 utilized to deliver liquified natural gas to first floating storage unit 226, following unloading, may then be loaded with liquefied blended fuel from second floating storage unit 326. In one or more embodiments, liquefied natural gas transport vessel 230 may be moored at moorings 133 that are spaced apart from liquefied natural gas floating storage unit 126 and marine platform 120. In such case, a floating transfer terminal 131*a* may be utilized to transfer liquified natural gas from the liquified natural gas transport vessel 230 to the liquified natural gas floating storage unit 226. Likewise, following blending, a floating transfer terminal 131*b* may be utilized to transfer liquified blended fuel from the liquified natural gas floating storage unit 326 to the liquified natural gas transport vessel 230.

To accommodate both first floating storage unit 226 and second floating storage unit 326 in close proximity to marine platform 120, marine platform 120 may have at least a first side 120*a* and a second side 120*b* with first floating storage unit 226 moored adjacent the first side 120*a* of marine platform 120 and second floating storage unit 326 moored adjacent the second side 120*b* of marine platform 120. It will be appreciated that in some embodiments, first side 120*a* and second side 120*b* may oppose one as opposite sides of marine platform 120 to allow both the liquified natural gas floating storage unit 326 and the liquified hydrogen floating storage unit 226 to be closely moored adjacent marine platform 120 at the same time. In any event, the liquified natural gas floating storage unit 326 may include a plurality of bulk storage tanks 328 for receipt of blended liquified natural gas produced onboard marine platform 120.

Hydrogen fuel production system 310 produces gaseous hydrogen as described above utilizing water purification unit 140 to deliver purified water to hydrogen production unit 122. In one or more embodiments, the electricity for hydrogen production unit 122 is provided to marine platform 120 for the production of hydrogen by offshore wind turbines 132 disposed in the vicinity of marine platform 120. In addition, liquefied natural gas from floating storage unit 226 is regasified by regasification system 232 to produce natural gas, after which the produced hydrogen and natural gas are mixed together in desired proportions by blending unit 234. Thus, each of regasification system 232 and hydrogen production unit 122 are in fluid communication with blending unit 234 which produces a blended fuel from the input gasses. Although the blending process and blended fuel as described herein are not limited to a particular blending ratio, in one or more embodiments, the blended fuel comprises no more than about 25% hydrogen. In other embodiments, the proportion of hydrogen in the blended fuel may be higher.

The blended fuel from blending unit 234 is then conveyed to liquefaction unit 224 where the blended fuel is liquified before loading onto second liquified natural gas floating storage unit 326.

In one or more embodiments, a portion of the blended fuel may be transmitted to an onshore or near shore location or terminal via a conveyance system 144, such as the illustrated gas pipeline conveyance system 144. Alternatively, or in addition thereto, a portion of the blended fuel may be utilized onboard marine platform 120 to generate electricity. Thus, marine platform 120 may include one or more combustion turbines 148, such as shown in FIG. 4, for combusting the blended fuel to provide mechanical power that is converted to electric power by one or more electric generators 150 such as is shown in FIG. 4. In this case, conveyance system 144 may be an electrical cable in addition to or as an alternative to a gas pipeline. Where conveyance system 144 is an electrical cable, excess electricity from offshore wind turbines 132 may be transmitted to shore from marine platform 120 along with electricity produced from electric generators 150. In some embodiments, electricity from offshore wind turbines 132 may be utilized to produce hydrogen for blending with natural gas, while electricity from electric generators 150 may be transmitted via conveyance system 144.

Moreover, in the case where blended fuel is utilized in the combustion turbines 148, the combustion turbines are in fluid communication, either directly or indirectly, with the blending unit 234 in order to utilize at least a portion of the blended fuel in the combustion turbines 148.

Figure 6:
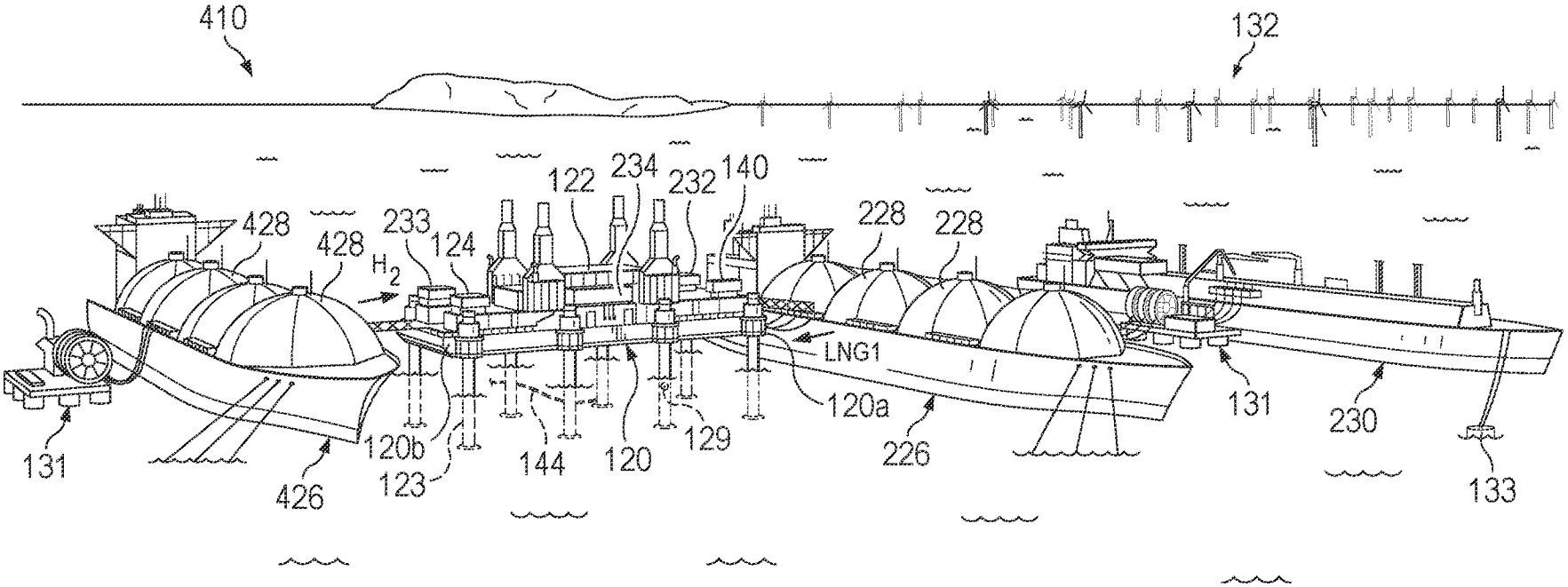
FIG. 6 is another embodiment of an offshore marine system for production of hydrogen-blended fuel.

FIG. 6 illustrates another embodiment of a hydrogen fuel production system 410 disposed to produce blended natural gas in order to accommodate combustion systems that are not disposed for combustion of hydrogen gas alone. In this embodiment, the liquefied natural gas having a first percentage of hydrogen (LNG1) is delivered to marine platform 120 by liquefied natural gas transport vessel 230 and stored on a liquefied natural gas floating storage unit 226 for regasification. The percentage amount of hydrogen in the delivered natural gas may be minimal, such as less than 0.5% in some embodiments, or less than 1% in other embodiments or less than 3% in yet other embodiments. In still other embodiments, the percentage of hydrogen in the delivered natural gas LNG1 is simply less than a desired percentage of hydrogen in a blended fuel.

In any event, the delivered natural gas LNG1 is regassified and blended with gaseous hydrogen from a hydrogen source at marine platform 120. In some embodiments, the hydrogen source at marine platform 120 is liquid hydrogen stored adjacent marine platform 120 on a liquified hydrogen floating storage unit 426, which liquid hydrogen is regassified on board marine platform 120. Hydrogen fuel production system 410 therefore includes a first pump to transfer by pumping the delivered natural gas LNG1 from floating storage unit 226 to marine platform 120 for processing. Specifically, the delivered natural gas and hydrogen are then blended to produce a blended fuel, namely natural gas with a desired percentage of hydrogen comprising the blended fuel.

In one or more embodiments, the liquified hydrogen from floating storage unit 426 is produced on marine platform 120 as described above with respect to FIGS. 1-3, after which the produced hydrogen is liquefied onboard marine platform 120 before being stored in bulk storage tanks 428 of floating storage unit 426. In other embodiments, the liquefied hydrogen may be delivered to floating storage unit 426 by a cryogenic transport vessel similar to transport vessel 230. In either case, hydrogen fuel production system 410 therefore includes a second pump to transfer by pumping the liquified hydrogen from floating storage unit 426 to marine platform 120 for processing. Where liquefied hydrogen is delivered to floating storage unit 426 from a transport vessel, marine platform 120 need not include the hydrogen production system described in FIGS. 1-3. Moreover, it will be appreciated that hydrogen production unit 122, such as is described in FIGS. 1-3, may have a low output volume, and thus may need to be producing hydrogen for blending even when blending operations on marine platform 120 are suspended, such as could be the case when the supply of LNG1 on storage vessel 226 is low. In other words, hydrogen production may be continuous or semi-continuous as compared to blending. Hence the need for bulk storage tanks 428 of floating storage unit 426 which can be utilized to collect and store the produced hydrogen until it is needed for blending as described herein.

In yet other embodiments, gaseous hydrogen may be produced onboard marine platform 120 and a portion of the produced hydrogen may be used directly in the blending process without first liquefying and storing the hydrogen on floating storage unit 426. In such case, floating storage unit 426 may be used to store the excess hydrogen produced onboard marine platform 120.

In this same vein, it will be appreciated that the percentage of hydrogen that can be blended with natural gas for use in industry will increase over time as equipment is upgraded or manufactured to utilize fuel with higher percentages of hydrogen. Floating storage unit 426 affords the flexibility to provide higher percentages of hydrogen for blending as industry demands change.

In one or more embodiments, liquefied natural gas transport vessel 230 may be moored at moorings 133 that are spaced apart from liquefied natural gas floating storage unit 226 and marine platform 120. In such case, a floating transfer terminal 131 may be utilized to transfer liquified natural gas from liquefied natural gas transport vessel 230 to liquefied natural gas floating storage unit 226.

While hydrogen may be delivered to liquefied hydrogen floating storage unit 426, in the embodiment shown in FIG. 6, however, hydrogen may be produced onboard marine platform 120 and stored on floating storage unit 426 until ready for use in a blending process. Thus, hydrogen fuel production system 410 may include a hydrogen production unit 122, a water purification unit 140 and a hydrogen liquefaction unit 124 as described above with respect to FIG. 1. In addition, hydrogen fuel production system 410 also includes a first regasification system 232, a second regasification system 233, and a blending unit 234. In the illustrated embodiment, a first floating storage unit 226 having storage tanks 228 is provided adjacent marine platform 120 and disposed to bulk store liquefied natural gas delivered by a first transport vessel 230. In addition, a second floating storage unit 426 having storage tanks 428 is provided adjacent marine platform 120 and disposed to bulk store liquefied hydrogen. In this regard, marine platform 120 may have at least a first side 120*a* and a second side 120*b* with first floating storage unit 226 moored adjacent the first side 120*a* of marine platform 120 and second floating storage unit 426 moored adjacent the second side 120*b* of marine platform 120. The first floating storage unit 226 is disposed to store liquified natural gas and the second floating storage unit 426 is disposed to store liquified hydrogen.

Hydrogen fuel production system 410 produces gaseous hydrogen as described above utilizing water purification unit 140 to deliver purified water to hydrogen production unit 122. Liquefaction unit 124 converts the produced gaseous hydrogen to liquified hydrogen for storage. In one or more embodiments, the electricity for hydrogen production unit 122 is provided to marine platform 120 for the production of hydrogen by offshore wind turbines 132 disposed in the vicinity of marine platform 120.

Prior to blending in blending unit 234, liquefied natural gas from first floating storage unit 226 is regasified by first regasification system 232 to produce natural gas, and liquified hydrogen from second floating storage unit 426 is regasified by second regasification system 233, after which the resulting gaseous hydrogen and gaseous natural gas are mixed together in desired proportions by blending unit 234. Thus, each of first regasification system 232 and second regasification system 233 are in fluid communication with blending unit 234 which produces a blended fuel from the input gasses. Although the blending process and blended fuel as described herein are not limited to a particular blending ratio, in one or more embodiments, the blended fuel comprises no more than about 25% hydrogen. In other embodiments, the proportion of hydrogen in the blended fuel may be higher.

In one or more embodiments, a portion of the blended fuel may be transmitted to an onshore or near shore location or terminal via a conveyance system 144, such as the illustrated gas pipeline conveyance system 144. Alternatively, or in addition thereto, a portion of the blended fuel may be utilized onboard marine platform 120 to generate electricity. Thus, marine platform 120 may include one or more combustion turbines 148 such as is shown in FIG. 4 for combusting the blended fuel to provide mechanical power that is converted to electric power by one or more electric generators 150 such as is shown in FIG. 4. In this case, conveyance system 144 may be an electrical cable in addition to or as an alternative to a gas pipeline. Where conveyance system 144 is an electrical cable, excess electricity from offshore wind turbines 132 may be transmitted to shore from marine platform 120 along with electricity produced from electric generators 150. In some embodiments, electricity from offshore wind turbines 132 may be utilized to produce hydrogen for mixing with natural gas, while electricity from electric generators 150 may be transmitted via conveyance system 144.

Moreover, in the case where blended fuel is utilized in the combustion turbines 148, the combustion turbines are in fluid communication, either directly or indirectly, with the blending unit 234 in order to utilize at least a portion of the blended fuel in the combustion turbines 148.

Thus, a system for offshore production of fuel has been described. The system may include an offshore marine platform; a water purification unit on the marine platform; at least one hydrogen production unit on the marine platform in fluid communication with the water purification unit; a hydrogen liquefaction system on the marine platform in fluid communication with the hydrogen production unit; and a liquified hydrogen floating storage unit moored adjacent the marine platform and in fluid communication with the hydrogen liquefaction system. In other embodiments, the system may include an offshore marine platform; a plurality of offshore wind turbines in the vicinity of marine platform and disposed to provide electricity to the marine platform; a water purification unit on the marine platform; at least one hydrogen production unit on the marine platform in fluid communication with the water purification unit; a hydrogen liquefaction system on the marine platform in fluid communication with the hydrogen production unit; and a liquified hydrogen floating storage unit moored adjacent the marine platform and in fluid communication with the hydrogen liquefaction system. In other embodiments, the system may include an offshore marine platform; a water purification unit on the marine platform; at least one hydrogen production unit on the marine platform in fluid communication with the water purification unit; a liquified natural gas floating storage unit moored adjacent the marine platform; a regasification system on the marine platform and in fluid communication with the liquified natural gas floating storage unit, the regasification system disposed to convert the liquefied natural gas to gaseous natural gas; and a blending unit on the marine platform and in fluid communication with each of the regasification system and the at least one hydrogen production unit, the blending unit disposed to receive gaseous natural gas with a first percentage of hydrogen and blend the received natural gas with gaseous hydrogen to produce blended natural gas with a second percentage of hydrogen. In other embodiments, the system may include an offshore marine platform; a plurality of offshore wind turbines in the vicinity of marine platform and disposed to provide electricity to the marine platform; a water purification unit on the marine platform; at least one hydrogen production unit on the marine platform in fluid communication with the water purification unit and disposed to produce gaseous hydrogen; a liquified natural gas floating storage unit moored adjacent the marine platform; a first regasification system on the marine platform and in fluid communication with the liquified natural gas floating storage unit, the first regasification system disposed to convert the liquefied natural gas to gaseous natural gas; and a blending unit on the marine platform and in fluid communication with the regasification system and the at least one hydrogen production unit, the blending unit disposed to receive gaseous natural gas with a first percentage of hydrogen and blend the received natural gas with gaseous hydrogen to produce blended natural gas with a second percentage of hydrogen. In other embodiments, the system may include an offshore marine platform; a water purification unit on the marine platform; at least one hydrogen production unit on the marine platform in fluid communication with the water purification unit; a first liquified natural gas floating storage unit moored adjacent the marine platform and having storage tanks with liquified natural gas having a first percentage of hydrogen stored therein; a second liquified natural gas floating storage unit moored adjacent the marine platform and having storage tanks with liquefied natural gas having a second percentage of hydrogen stored therein; a regasification system on the marine platform and in fluid communication with the first liquified natural gas floating storage unit, the regasification system disposed to convert the liquefied natural gas with a first percentage of hydrogen to gaseous natural gas with a first percentage of hydrogen; a blending unit on the marine platform and in fluid communication with each of the regasification system and the at least one hydrogen production unit, the blending unit disposed to receive the gaseous natural gas with a first percentage of hydrogen and blend the received natural gas with gaseous hydrogen to produce the gaseous natural gas having a second percentage of hydrogen; and a liquefaction unit in fluid communication with the blending unit and the second liquified natural gas floating storage unit, the liquefaction system disposed to convert the gaseous natural gas having the second percentage of hydrogen into liquefied natural gas having the second percentage of hydrogen for storage on the second liquified natural gas floating storage unit. In other embodiments, the system may include an offshore marine platform; a source of hydrogen at the marine platform; a first liquified natural gas floating storage unit moored adjacent the marine platform and having storage tanks with liquified natural gas having a first percentage of hydrogen stored therein; a second liquified natural gas floating storage unit moored adjacent the marine platform and having storage tanks with liquefied natural gas having a second percentage of hydrogen stored therein; a regasification system on the marine platform and in fluid communication with the first liquified natural gas floating storage unit, the regasification system disposed to convert the liquefied natural gas with a first percentage of hydrogen to gaseous natural gas with a first percentage of hydrogen; and a blending unit on the marine platform and in fluid communication with each of the regasification system and the source of hydrogen, the blending unit disposed to receive the gaseous natural gas with a first percentage of hydrogen and blend the received natural gas with hydrogen to produce the gaseous natural gas having a second percentage of hydrogen; and a liquefaction unit in fluid communication with the blending unit and the second liquified natural gas floating storage unit, the liquefaction system disposed to convert the gaseous natural gas having the second percentage of hydrogen into liquefied natural gas having the second percentage of hydrogen for storage on the second liquified natural gas floating storage unit; a first pump disposed to convey liquified natural gas having the first percentage of hydrogen from the first liquified natural gas floating storage unit to the regasification system; and a second pump disposed to convey liquified natural gas having the second percentage of hydrogen from the liquefaction unit to the second liquified natural gas floating storage unit. In other embodiments, the system may include an offshore marine platform; a water purification unit on the marine platform; at least one hydrogen production unit on the marine platform in fluid communication with the water purification unit; a liquified natural gas floating storage unit moored adjacent the marine platform and having storage tanks with liquified natural gas having a first percentage of hydrogen stored therein; a liquified hydrogen floating storage unit moored adjacent the marine platform and having storage tanks with liquefied hydrogen stored therein; a first liquefaction unit in fluid communication with the hydrogen production unit and the liquefied hydrogen floating storage unit, the first liquefaction system disposed to convert the gaseous hydrogen into liquefied hydrogen for storage on the liquefied hydrogen storage unit; a first regasification system on the marine platform and in fluid communication with the liquified natural gas floating storage unit, the first regasification system disposed to convert the liquefied natural gas with a first percentage of hydrogen to gaseous natural gas with a first percentage of hydrogen; a second regasification system on the marine platform and in fluid communication with the liquified hydrogen floating storage unit, the second regasification system disposed to convert the liquefied hydrogen to gaseous hydrogen; and a blending unit on the marine platform and in fluid communication with each of the first regasification system and the second regasification system, the blending unit disposed to receive the gaseous natural gas with a first percentage of hydrogen and blend the received natural gas with gaseous hydrogen to produce the gaseous natural gas having a second percentage of hydrogen. In other embodiments, the system may include an offshore marine platform; a liquified natural gas floating storage unit moored adjacent the marine platform and having storage tanks with liquified natural gas having a first percentage of hydrogen stored therein; a liquified hydrogen floating storage unit moored adjacent the marine platform and having storage tanks with liquefied hydrogen stored therein; a first regasification system on the marine platform and in fluid communication with the liquified natural gas floating storage unit, the first regasification system disposed to convert the liquefied natural gas with a first percentage of hydrogen to gaseous natural gas with a first percentage of hydrogen; a second regasification system on the marine platform and in fluid communication with the liquified hydrogen floating storage unit, the second regasification system disposed to convert the liquefied hydrogen to gaseous hydrogen; a blending unit on the marine platform and in fluid communication with each of the first regasification system and the second regasification system, the blending unit disposed to receive the gaseous natural gas with a first percentage of hydrogen and blend the received natural gas with gaseous hydrogen to produce the gaseous natural gas having a second percentage of hydrogen; a first pump disposed to convey liquified natural gas having the first percentage of hydrogen from the liquified natural gas floating storage unit to the first regasification system; and a second pump disposed to convey liquified hydrogen from the liquified hydrogen floating storage unit to the second regasification system.

Any of the foregoing offshore production of fuel systems may further include, alone or in combination, any of the following:

The marine platform comprises a platform deck and three or more platform legs supporting the platform deck, with at least one seawater intakes disposed along at least one leg and in fluid communication with the water purification unit.

The offshore marine platform is a jack-up platform affixed to an ocean floor.

A liquified natural gas floating storage unit moored adjacent the marine platform; a first regasification system on the marine platform and in fluid communication with the liquified natural gas floating storage unit; a blending unit on the marine platform and in fluid communication with the first regasification system.

One or more combustion turbines disposed to combust hydrogen-based fuel produced on the marine platform.

One or more electric generators driven by the combustion turbines.

A conveyance system extending away from the marine platform.

The conveyance system comprises both a gas pipeline and an electrical cable.

The water purification unit comprises a water purification vessel having a first chamber and a second chamber with a semi-permeable membrane disposed between the first and second chambers, a seawater inlet in the first chamber; a purified water outlet in the second chamber; a pump for pressurizing the seawater in the first chamber, where the pump is in fluid communication with one or more seawater intakes to draw in seawater for purification.

The hydrogen production unit comprises a hydrogen production vessel having a first chamber and a second chamber with a membrane disposed between the first and second chambers, an anode assembly having an anode extending into first chamber provided on a first side a of the membrane; a cathode assembly having a cathode extending into second chamber on a second side of membrane; a power supply electrically coupled to the anode assembly and cathode assembly; an oxygen outlet 190 in first chamber; and a hydrogen outlet in second chamber.

The blending unit is also in fluid communication with the hydrogen production unit.

A liquified natural gas floating storage unit moored adjacent the marine platform; a regasification system on the marine platform and in fluid communication with the liquified natural gas floating storage unit; a blending unit on the marine platform and in fluid communication with the regasification system and the hydrogen production unit.

One or more combustion turbines disposed to combust hydrogen-based fuel produced on the marine platform; one or more electric generators driven by the one or more combustion turbines; and a conveyance system electrically coupled to the one or more electric generators and extending away from the marine platform.

One or more combustion turbines disposed to combust produce blended natural gas produced on the marine platform; one or more electric generators driven by the one or more combustion turbines; and a conveyance system extending away from the marine platform.

The conveyance system comprises a gas pipeline in fluid communication with the hydrogen production unit.

The conveyance system comprises both a gas pipeline in fluid communication with the hydrogen production unit and an electrical cable electrically coupled to one or more electric generators.

The water purification unit comprises a water purification vessel having a first chamber and a second chamber with a semi-permeable membrane disposed between the first and second chambers; a seawater inlet in the first chamber; a purified water outlet in the second chamber; a pump for pressurizing the seawater in the first chamber, where the pump is in fluid communication with one or more seawater intakes to draw in seawater for purification.

The hydrogen production unit comprises a hydrogen production vessel having a first chamber and a second chamber with a membrane disposed between the first and second chambers; an anode assembly having an anode extending into first chamber provided on a first side of the membrane; a cathode assembly having a cathode extending into second chamber on a second side of membrane; a power supply electrically coupled to the anode assembly and cathode assembly; an oxygen outlet in first chamber; and a hydrogen outlet in second chamber.

The plurality of offshore wind turbines provide electricity to the at least one hydrogen production unit, the regasification system and the blending unit.

The marine platform comprises a platform deck and three or more platform legs supporting the platform deck, with at least one seawater intake disposed along at least one leg at first distance from an end of the leg and at least one seawater intake disposed along at least one leg at a second distance from an end of the leg, where the second distance is greater than the first distance.

A liquified hydrogen floating storage unit moored adjacent the marine platform; a second regasification system on the marine platform and in fluid communication with the liquified hydrogen floating storage unit, wherein the second regasification system is in fluid communication with the blending unit.

A first pump disposed to convey liquified natural gas having the first percentage of hydrogen from the first liquified natural gas floating storage unit to the regasification system; and a second pump disposed to convey liquified natural gas having the second percentage of hydrogen from the liquefaction unit to the second liquified natural gas floating storage unit.

A plurality of offshore wind turbines disposed in the vicinity of marine platform.

The conveyance system comprises a gas pipeline in fluid communication with the blending unit.

The conveyance system comprises an electrical cable electrically coupled to one or more electric generators.

The conveyance system comprises both a gas pipeline in fluid communication with the blending unit and an electrical cable electrically coupled to one or more electric generators.

The source of hydrogen comprises a water purification unit on the marine platform; at least one hydrogen production unit on the marine platform in fluid communication with the water purification unit; and a plurality of offshore wind turbines providing electricity to the at least one hydrogen production units.

The marine platform has at least a first side and a second side with first liquified natural gas floating storage unit moored adjacent the first side of marine platform and second liquified natural gas floating storage unit moored adjacent the second side of marine platform.

One or more combustion turbines 148 disposed to combust the gaseous natural gas having a second percentage of hydrogen; one or more electric generators 150 driven by the one or more combustion turbines; and a conveyance system extending away from the marine platform.

A first pump disposed to convey liquified natural gas having the first percentage of hydrogen from the liquified natural gas floating storage unit to the first regasification system; and a second pump disposed to convey liquified hydrogen from the liquified hydrogen floating storage unit to the second regasification system.

A plurality of offshore wind turbines disposed in the vicinity of marine platform and electrically coupled to the marine platform to supply electricity to the at least one hydrogen production unit.

The conveyance system comprises one of a gas pipeline in fluid communication with the blending unit and an electrical cable electrically coupled to one or more electric generators.

A second liquefaction unit in fluid communication with the blending unit, the second liquefaction system disposed to convert the gaseous natural gas having the second percentage of hydrogen into liquefied natural gas having the second percentage of hydrogen.

The marine platform has at least a first side and a second side with liquified natural gas floating storage unit moored adjacent the first side of marine platform and the liquified hydrogen floating storage unit moored adjacent the second side of marine platform.

A water purification unit on the marine platform; at least one hydrogen production unit on the marine platform in fluid communication with the water purification unit; a plurality of offshore wind turbines providing electricity to the at least one hydrogen production unit; and a first liquefaction unit in fluid communication with the hydrogen production unit and the liquefied hydrogen floating storage unit, the first liquefaction system disposed to convert the gaseous hydrogen into liquefied hydrogen for storage on the liquefied hydrogen storage unit.

One or more combustion turbines disposed to combust the gaseous natural gas having a second percentage of hydrogen; one or more electric generators driven by the one or more combustion turbines; and a conveyance system extending away from the marine platform.

Likewise, a method for offshore production of fuel has been described. The method may include pumping seawater to a water purification unit mounted on an offshore marine platform affixed to the seabed; utilizing the water purification unit to at least partially purifying the pumped seawater to yield purified water; utilizing a hydrogen production unit mounted on the offshore marine platform to produce gaseous hydrogen from the purified water; liquifying at least a portion of the gaseous hydrogen onboard the marine platform; transferring the liquified hydrogen to a liquified hydrogen floating storage unit moored adjacent the marine platform for storage of the liquefied hydrogen on the liquified hydrogen floating storage unit; and transferring liquified hydrogen stored on the liquified hydrogen floating storage unit to a liquefied hydrogen transport vessel. In other embodiments, the method may include supplying electricity to an offshore marine platform from a plurality of offshore wind turbines; pumping seawater to a water purification unit mounted on an offshore marine platform affixed to the seabed; utilizing the water purification unit to at least partially purifying the pumped seawater to yield purified water; utilizing a hydrogen production unit mounted on the offshore marine platform to produce gaseous hydrogen from the purified water; liquifying the gaseous hydrogen onboard the marine platform; and transferring the liquified hydrogen to a liquified hydrogen floating storage unit moored adjacent the marine platform; wherein the electricity from the offshore wind turbines is utilized at least by the hydrogen production unit to produce gaseous hydrogen. In other embodiments, the method may include pumping seawater to a water purification unit mounted on an offshore marine platform affixed to the seabed; utilizing the water purification unit to at least partially purifying the pumped seawater to yield purified water; utilizing a hydrogen production unit mounted on the offshore marine platform to produce gaseous hydrogen from the purified water; delivering liquefied natural gas to the marine platform, the delivered natural gas having a first hydrogen content; gasifying the delivered natural gas to produce gaseous natural gas; blending the gaseous natural gas with at least a portion of the gaseous hydrogen produced on the marine platform to produce a blended fuel comprising natural gas with a second hydrogen content greater than the first hydrogen content. In other embodiments, the method may include pumping seawater to a water purification unit mounted on an offshore marine platform affixed to the seabed; utilizing the water purification unit to at least partially purifying the pumped seawater to yield purified water; utilizing a hydrogen production unit mounted on the offshore marine platform to produce gaseous hydrogen from the purified water; delivering liquefied natural gas to the marine platform, the delivered natural gas having a first percentage of hydrogen; gasifying the delivered natural gas to produce gaseous natural gas having a first percentage of hydrogen; blending the gaseous natural gas having a first percentage of hydrogen with at least a portion of the gaseous hydrogen produced on the marine platform to produce a gaseous natural gas having a second percentage of hydrogen; and liquefying at least a portion of the natural gas having the second percentage of hydrogen. In other embodiments, the method may include providing gaseous hydrogen at an offshore marine platform; delivering liquefied natural gas to the marine platform, the delivered liquified natural gas having a first percentage of hydrogen; gasifying the delivered natural gas to produce gaseous natural gas having a first percentage of hydrogen; blending the gaseous natural gas having a first percentage of hydrogen with at least a portion of the gaseous hydrogen to produce a gaseous natural gas having a second percentage of hydrogen; and liquefying at least a portion of the natural gas having the second percentage of hydrogen. In other embodiments, the method may include providing gaseous hydrogen at an offshore marine platform; delivering liquefied natural gas to the marine platform, the delivered natural gas having a first percentage of hydrogen; gasifying the delivered natural gas to produce gaseous natural gas having a first percentage of hydrogen; blending the gaseous natural gas having a first percentage of hydrogen with at least a portion of the gaseous hydrogen to produce a gaseous natural gas having a second percentage of hydrogen; combusting a portion of the gaseous natural gas having a second percentage of hydrogen in combustion turbines in order to produce electricity onboard the marine platform; and conveying the produced electricity away from the marine platform. In other embodiments, the method may include pumping seawater to a water purification unit mounted on an offshore marine platform affixed to the seabed; utilizing the water purification unit to at least partially purifying the pumped seawater to yield purified water; utilizing a hydrogen production unit mounted on the offshore marine platform to produce gaseous hydrogen from the purified water; liquefying at least a portion of the gaseous hydrogen and storing the liquefied gaseous hydrogen on a liquified hydrogen floating storage unit moored adjacent the marine platform; delivering liquefied natural gas to the marine platform, the delivered natural gas having a first percentage of hydrogen; gasifying the delivered natural gas to produce gaseous natural gas having a first percentage of hydrogen; blending the gaseous natural gas having a first percentage of hydrogen with at least a portion of the gaseous hydrogen produced on the marine platform to produce a gaseous natural gas having a second percentage of hydrogen; combusting at least a portion of the gaseous natural gas having a second percentage of hydrogen in combustion turbines in order to produce electricity onboard the marine platform; conveying the produced electricity away from the marine platform. In other embodiments, the method may include providing gaseous hydrogen at an offshore marine platform; delivering liquefied natural gas to the marine platform, the delivered natural gas having a first percentage of hydrogen; storing the delivered liquefied natural gas in a first floating storage unit adjacent the marine platform; gasifying the delivered natural gas to produce gaseous natural gas having a first percentage of hydrogen; blending the gaseous natural gas having a first percentage of hydrogen with at least a portion of the gaseous hydrogen to produce a gaseous natural gas having a second percentage of hydrogen; and combusting at least a portion of the gaseous natural gas having a second percentage of hydrogen in combustion turbines in order to produce electricity onboard the marine platform; conveying the produced electricity away from the marine platform.

Any of the foregoing embodiments of a method may include, alone or in combination, any of the following:

- The gaseous hydrogen is produced by the hydrogen production unit utilizing electrolysis.
- The purified water is produced by the water purification unit utilizing reverse osmosis.
- Utilizing a portion of the blended fuel in combustion turbines in order to produce electricity onboard the marine platform.
- Utilizing a portion of the gaseous hydrogen in combustion turbines in order to produce electricity onboard the marine platform.
- Utilizing a seabed conveyance system to transfer a portion of the gaseous hydrogen to a location remote from the marine platform.
- The gaseous hydrogen is produced by the hydrogen production unit utilizing electrolysis and the purified water is produced by the water purification unit utilizing reverse osmosis.
- Supplying liquefied natural gas to the marine platform; gasifying the liquefied natural gas supplied to the marine platform to produce gaseous natural gas; and blending the gaseous natural gas with at least a portion of the gaseous hydrogen produced on the marine platform to produce a blended fuel.
- Utilizing a seabed conveyance system to transfer a portion of the blended fuel to a location remote from the marine platform.
- Combusting a portion of the gaseous natural gas having a second percentage of hydrogen in combustion turbines in order to produce electricity onboard the marine platform.
- Utilizing a seabed conveyance system to transfer a portion of the gaseous natural gas having a second percentage of hydrogen to a location remote from the marine platform.
- Storing the delivered liquefied natural gas in a first floating storage unit adjacent the marine platform; and storing the liquefied natural gas having the second percentage of hydrogen in a second floating storage unit adjacent the marine platform.
- Pumping liquified natural gas having the first percentage of hydrogen from the first liquified natural gas floating storage unit to the marine platform for gasification; and pumping liquified natural gas having the second percentage of hydrogen from the marine platform to the second liquified natural gas floating storage unit.
- Delivering liquefied natural gas to the marine platform comprises delivering liquefied natural gas to the first floating storage unit adjacent the marine platform utilizing a liquefied natural gas transport vessel; and further comprising loading liquefied natural gas having the second percentage of hydrogen from the second floating storage unit to the liquefied natural gas transport vessel utilized to deliver the liquefied natural gas having the first percentage of hydrogen.
- Storing the delivered liquefied natural gas in a first floating storage unit adjacent the marine platform.
- Providing gaseous hydrogen comprises pumping liquefied hydrogen from a liquefied hydrogen floating storage unit moored adjacent the marine platform to the marine platform and gasifying the liquefied hydrogen to produce gaseous hydrogen.

Although various embodiments have been shown and described, the disclosure is not limited to such embodiments and will be understood to include all modifications and variations as would be apparent to one skilled in the art.

Therefore, it should be understood that the disclosure is not intended to be limited to the particular forms disclosed; rather, the intention is to cover all modifications, equivalents, and alternatives falling within the spirit and scope of the disclosure as defined by the appended claims.

What is claimed:

1. A system for offshore production of fuel comprising:
an offshore marine platform;
a water purification unit on the marine platform;
at least one hydrogen production unit on the marine platform in fluid communication with the water purification unit;
a liquified natural gas floating storage unit moored adjacent the marine platform;
a first regasification system on the marine platform and in fluid communication with the liquified natural gas floating storage unit; and
a blending unit on the marine platform and in fluid communication with the first regasification system and the hydrogen production unit.

2. The system of claim 1, wherein the marine platform comprises a platform deck and three or more platform legs supporting the platform deck, with at least one seawater intakes disposed along at least one leg and in fluid communication with the water purification unit.

3. The system of claim 2, wherein the offshore marine platform is a jack-up platform affixed to an ocean floor.

4. The system of claim 1, further comprising a plurality of offshore wind turbines disposed in the vicinity of marine platform.

5. The system of claim 1, further comprising a blended fuel liquefaction system on the marine platform in fluid communication with the blending unit; and
a liquified blended fuel floating storage unit moored adjacent the marine platform and in fluid communication with the blended fuel liquefaction.

6. A system for offshore production of fuel comprising:
an offshore marine platform;
a water purification unit on the marine platform;
at least one hydrogen production unit on the marine platform in fluid communication with the water purification unit;
a hydrogen floating storage unit moored adjacent the marine platform and in fluid communication with the hydrogen production unit; and
one or more combustion turbines disposed to combust hydrogen-based fuel produced on the marine platform.

7. The system of claim 6, further comprising one or more electric generators driven by the combustion turbines.

8. The system of claim 1, further comprising a conveyance system extending away from the marine platform.

9. The system of claim 8, wherein the conveyance system comprises a gas pipeline in fluid communication with the blending unit.

10. A system for offshore production of fuel comprising:
an offshore marine platform;
a water purification unit on the marine platform;
at least one hydrogen production unit on the marine platform in fluid communication with the water purification unit;
a hydrogen liquefaction system on the marine platform in fluid communication with the hydrogen production unit;
a liquified hydrogen floating storage unit moored adjacent the marine platform and in fluid communication with the hydrogen liquefaction system; and
a conveyance system extending away from the marine platform,
wherein the conveyance system comprises an electrical cable electrically coupled to one or more electric generators.

11. A system for offshore production of fuel comprising:
an offshore marine platform;
a water purification unit on the marine platform;
at least one hydrogen production unit on the marine platform in fluid communication with the water purification unit;
a hydrogen liquefaction system on the marine platform in fluid communication with the hydrogen production unit;
a liquified hydrogen floating storage unit moored adjacent the marine platform and in fluid communication with the hydrogen liquefaction system; and
a conveyance system extending away from the marine platform,
wherein the conveyance system comprises both a gas pipeline and an electrical cable.

12. A system for offshore production of fuel comprising:
an offshore marine platform;
a water purification unit on the marine platform;
at least one hydrogen production unit on the marine platform in fluid communication with the water purification unit;
a hydrogen liquefaction system on the marine platform in fluid communication with the hydrogen production unit; and
a liquified hydrogen floating storage unit moored adjacent the marine platform and in fluid communication with the hydrogen liquefaction system,
wherein the water purification unit comprises a water purification vessel having a first chamber and a second chamber with a semi-permeable membrane disposed between the first and second chambers, a seawater inlet in the first chamber; a purified water outlet in the second chamber; a pump for pressurizing the seawater in the first chamber, where the pump is in fluid communication with one or more seawater intakes to draw in seawater for purification.

13. The system of claim 12, wherein the hydrogen production unit comprises a hydrogen production vessel having a first chamber and a second chamber with a membrane disposed between the first and second chambers, an anode assembly having an anode extending into first chamber provided on a first side a of the membrane; a cathode assembly having a cathode extending into second chamber on a second side of membrane; a power supply electrically coupled to the anode assembly and cathode assembly; an oxygen outlet 190 in first chamber; and a hydrogen outlet in second chamber.

14. A system for offshore production of fuel comprising:
an offshore marine platform having a platform deck and three or more platform legs supporting the platform deck, with at least one seawater intake disposed along at least one leg at first distance from an end of the leg and at least one seawater intake disposed along at least one leg at a second distance from an end of the leg, where the second distance is greater than the first distance;
a plurality of offshore wind turbines in the vicinity of marine platform and disposed to provide electricity to the marine platform;

a water purification unit on the marine platform;

at least one hydrogen production unit on the marine platform in fluid communication with the water purification unit;

a hydrogen liquefaction system on the marine platform in fluid communication with the hydrogen production unit; and a liquified hydrogen floating storage unit moored adjacent the marine platform and in fluid communication with the hydrogen liquefaction system.

15. A system for offshore production of fuel comprising:

an offshore marine platform;

a plurality of offshore wind turbines in the vicinity of marine platform and disposed to provide electricity to the marine platform;

a water purification unit on the marine platform;

at least one hydrogen production unit on the marine platform in fluid communication with the water purification unit;

a hydrogen liquefaction system on the marine platform in fluid communication with the hydrogen production unit;

a liquified hydrogen floating storage unit moored adjacent the marine platform and in fluid communication with the hydrogen liquefaction system;

a liquified natural gas floating storage unit moored adjacent the marine platform;

a regasification system on the marine platform and in fluid communication with the liquified natural gas floating storage unit; and a blending unit on the marine platform and in fluid communication with the regasification system and the hydrogen production unit.

16. The system of claim 15, further comprising one or more combustion turbines disposed to combust hydrogen-based fuel produced on the marine platform; one or more electric generators driven by the one or more combustion turbines; and a conveyance system electrically coupled to the one or more electric generators and extending away from the marine platform.

17. A method for offshore production of fuel comprising:

pumping seawater to a water purification unit mounted on an offshore marine platform affixed to the seabed;

utilizing the water purification unit to at least partially purifying the pumped seawater to yield purified water;

utilizing a hydrogen production unit mounted on the offshore marine platform to produce gaseous hydrogen from the purified water;

liquifying at least a portion of the gaseous hydrogen onboard the marine platform;

transferring the liquified hydrogen to a liquified hydrogen floating storage unit moored adjacent the marine platform for storage of the liquefied hydrogen on the liquified hydrogen floating storage unit; and transferring liquified hydrogen stored on the liquified hydrogen floating storage unit to a liquefied hydrogen transport vessel; and utilizing a portion of the gaseous hydrogen in combustion turbines in order to produce electricity onboard the marine platform.

18. The method of claim 17, wherein the gaseous hydrogen is produced by the hydrogen production unit utilizing electrolysis.

19. The method of claim 18, wherein the purified water is produced by the water purification unit utilizing reverse osmosis.

20. A method for offshore production of fuel comprising:

pumping seawater to a water purification unit mounted on an offshore marine platform affixed to the seabed;

utilizing the water purification unit to at least partially purifying the pumped seawater to yield purified water;

utilizing a hydrogen production unit mounted on the offshore marine platform to produce gaseous hydrogen from the purified water;

supplying liquefied natural gas to the marine platform;

gasifying the liquefied natural gas supplied to the marine platform to produce gaseous natural gas; and blending the gaseous natural gas with at least a portion of the gaseous hydrogen produced on the marine platform to produce a blended fuel.

21. The method of claim 20, further comprising utilizing a portion of the blended fuel in combustion turbines in order to produce electricity onboard the marine platform.

22. The method of claim 20, further comprising liquifying at least a portion of the blended fuel onboard the marine platform;

transferring the liquified blended fuel to a liquified blended fuel floating storage unit moored adjacent the marine platform for storage of the liquefied blended fuel on the liquified blended fuel floating storage unit;

transferring liquified blended fuel stored on the liquified blended fuel floating storage unit to a liquefied blended fuel transport vessel.

23. The method of claim 20, further comprising utilizing a seabed conveyance system to transfer a portion of the blended fuel or hydrogen produced on the marine platform to a location remote from the marine platform.

24. A method for offshore production of fuel comprising:

supplying electricity to an offshore marine platform from a plurality of offshore wind turbines;

pumping seawater to a water purification unit mounted on an offshore marine platform affixed to the seabed;

utilizing the water purification unit to at least partially purifying the pumped seawater to yield purified water;

utilizing a hydrogen production unit mounted on the offshore marine platform to produce gaseous hydrogen from the purified water; and transferring at least a portion of the hydrogen to a hydrogen floating storage unit moored adjacent the marine platform;

supplying liquefied natural gas to the marine platform;

gasifying the liquefied natural gas supplied to the marine platform to produce gaseous natural gas; and blending the gaseous natural gas with at least a portion of the hydrogen produced on the marine platform to produce a blended fuel, wherein the electricity from the offshore wind turbines is utilized at least by the hydrogen production unit to produce gaseous hydrogen.

25. The method of claim 24, wherein the gaseous hydrogen is produced by the hydrogen production unit utilizing electrolysis and the purified water is produced by the water purification unit utilizing reverse osmosis.

26. A method for offshore production of fuel comprising supplying gaseous hydrogen at an offshore marine platform;

supplying liquefied natural gas to the marine platform;

gasifying the liquefied natural gas supplied to the marine platform to produce gaseous natural gas; and blending the gaseous natural gas with at least a portion of the supplied gaseous hydrogen to produce a blended fuel at the offshore marine platform.

27. The method of claim 26, further comprising utilizing a portion of the blended fuel in combustion turbines in order to produce electricity onboard the marine platform.

28. The method of claim 26, further comprising utilizing a seabed conveyance system to transfer a portion of the blended fuel to a location remote from the marine platform.

29. The system of claim 14, further comprising a blended fuel conveyance system extending away from the offshore marine platform.

* * * * *